US009833112B2

(12) United States Patent
Busha

(10) Patent No.: US 9,833,112 B2
(45) Date of Patent: Dec. 5, 2017

(54) SYSTEM FOR LATERAL SHOWER CURTAIN MOVEMENT

(71) Applicant: Charles Busha, Flint, MI (US)

(72) Inventor: Charles Busha, Flint, MI (US)

( * ) Notice: Subject to any disclaimer, the term of this patent is extended or adjusted under 35 U.S.C. 154(b) by 58 days.

(21) Appl. No.: 14/855,933

(22) Filed: Sep. 16, 2015

(65) Prior Publication Data

US 2017/0071417 A1 Mar. 16, 2017

(51) Int. Cl.
*A47K 3/38* (2006.01)

(52) U.S. Cl.
CPC ..... *A47K 3/38* (2013.01)

(58) Field of Classification Search
CPC ... A47K 3/38; A47K 1/02; A47K 1/10; A47K 1/102; A47K 1/142
USPC ..... 4/610, 608, 607, 558, 557
See application file for complete search history.

(56) References Cited

U.S. PATENT DOCUMENTS 2,796,227 A * 6/1957 Coakley ..... A47K 3/38 211/105.1
4,117,557 A * 10/1978 McPeak ..... A47K 3/38 160/330
D746,667 S * 1/2016 Vaccaro ..... D8/376

* cited by examiner

*Primary Examiner* — Huyen Le
(74) *Attorney, Agent, or Firm* — Jerry D Haynes; Law Office of Jerry D Haynes

(57) ABSTRACT

A system to enable lateral shower curtain movement including: a first open channel frame, where the first open channel frame attaches to a first sidewall of a shower stall; a second open channel frame, where the second channel frame respectively attach to a second sidewall of the shower stall and said second sidewall opposes the first sidewall; openings in each open channel frame, where the openings enable the insertion of an end of a shower rod; and a means to adhere each channel frame to each side wall. The means to adhere may include at least one of a double-sided tape, glue or mounting brackets. Preferably, each channel frame extends the entire length of each respective sidewall.

3 Claims, 1 Drawing Sheet

SYSTEM FOR LATERAL SHOWER CURTAIN MOVEMENT

BACKGROUND OF THE INVENTION

Field of Invention

The present invention relates to a device for an installation into a shower stall that enables lateral movement of a shower curtain or a shower curtain rod.

Description of Related Art

Many shower stalls and bathtubs include the use of a shower curtain to enclose the shower stall during use. The shower curtain is typically installed upon a rod that extends from one sidewall to the opposing side of a shower stall. The shower curtain is typically placed in a stationary position at the edge of the shower stall opening. One drawback to this installation is that the shower curtain can develop mold, fungi, bacteria and other microorganisms over a period of time. As a consequence many users must periodically replace the shower curtain or use cleaners to clean the shower curtain. The cause of the mold or fungi is due to the fact that the shower curtain is closed after use and the moisture remains dormant in the shower stall. This closure of the shower curtain increases the amount of time that moisture is within the enclosed shower stall and therefore increases the likelihood of the buildup of mold, fungi and other bacteria. It would consequently be advantageous to have a system that allows for the lateral movement of the shower curtain to expose the shower stall and therefore decrease the drying time associated with the shower stall after use.

SUMMARY OF THE INVENTION

The present invention relates to a system to enable lateral shower curtain movement including: a first open channel frame, where the first open channel frame attaches to a first sidewall of a shower stall; a second open channel frame, where the second channel frame respectively attach to a second sidewall of the shower stall and said second sidewall opposes the first sidewall; openings in each open channel frame, where the openings enable the insertion of an end of a shower rod; and a means to adhere each channel frame to each side wall. The means to adhere may include at least one of a double-sided tape, glue or mounting brackets. Preferably, each channel frame extends the entire length of each respective sidewall.

The present invention further relates to a method of providing exposure to a shower stall including the steps of: installing a first channel frame onto a first sidewall of a shower stall; installing a second channel frame onto a second sidewall of a shower stall, where the second sidewall opposes the first sidewall; inserting a shower rod into the first channel frame and the second channel frame; and moving the shower rod laterally within the first channel frame and second channel frame to expose the shower stall.

DETAILED DESCRIPTION

The present invention relates to a system that enables the lateral movement of a shower curtain by inserting the shower rod into a pair of open channel frames. The present invention places a channel frame on each respective sidewall of the shower stall. The shower rod is placed within the channel frame and therefore allows for the lateral movement of the shower rod in the channel. While the shower is in use, the shower rod may be moved to the edge of the shower stall as normally placed in a conventional shower. Upon completion of the shower, the shower rod may be moved laterally inside the shower stall and allow for the exposure of the shower stall to enable a more quicker drying of the moisture and residue in the shower stall after use.

Figure 1:
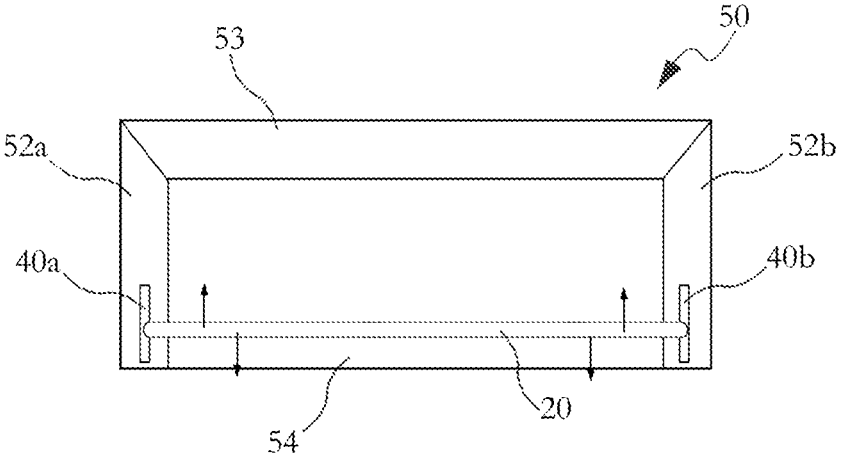
FIG. 1 depicts an overhead view of a shower stall with a lateral shower curtain system installed in accordance with the present invention.

In reference to FIG. 1, an overhead view of an open shower stall 50 is depicted. The shower stall 50 includes a back wall 53, side walls 52*a*, 52*b* and a opening edge 54. Near the opening edge 54 at near the top of the side walls 52*a*, 52*b*, open channel frames 40*a*, 40*b* are provided on each respective side wall 52*a*, 52*b*. A shower rod 20 is inserted into each respective channel frame 40*a*, 40*b* and enables the lateral movement of the shower rod 20 within the respective channel frames. The channel frames 40*a*, 40*b* may vary in length and may extend across the length of each respective side wall 52*a*, 52*b*, therefore enabling the lateral movement of the shower rod 20.

Figure 2:
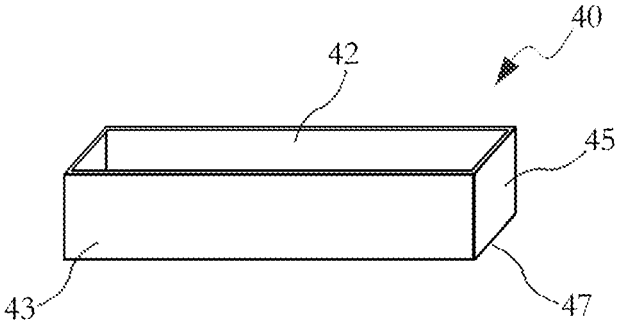
FIG. 2 depicts a perspective view of an open channel frame that is used in accordance with the present invention.

FIG. 2 depicts a perspective view of a channel frame 40 in accordance with the present invention. The channel frame 40 includes an opening 42, channel side wall 43 and end wall 45. A back side 47 is also on the underside of the channel frame 40. The opening 42 enables for the insertion of a shower rod into the channel frame. After insertion into the channel frame 40, the shower rod may be moved laterally as desired. A means to adhere the channel frame 40 to the sidewall is provided on the bottom side 47. A means to adhere this channel frame 40 to a shower stall sidewall may include double-sided tape, glue or even the installation of a mounting bracket. The placement of these channel frames on the shower wall sidewalls allows the shower rod to move laterally and therefore open and expose the shower stall or bathtub area to allow for the circulation of air. This air circulation enables for the quick and efficient drying of the shower stall to reduce the amount of mold or fungi that may develop in the shower stall. The instant invention has been shown and described in what it considers to be the most practical and preferred embodiments. It is recognized, however, that departures may be made there from within the scope of the invention and that obvious modifications will occur to a person skilled in the art.

What is claimed is:

1. A system to enable lateral shower curtain movement comprising:

a first open channel frame, where the first open channel frame attaches to a first sidewall of a shower stall;

a second open channel frame, where the second channel frame respectively attach to a second sidewall of the shower stall and said second sidewall opposes the first sidewall;

openings in each open channel frame, where the openings enable the insertion of an end of a shower rod, where the each channel frame extends the entire length of each respective sidewall enabling full exposure of a shower stall within the sidewalls; and a means to adhere each vertical channel frame to each side wall.

2. The system according to claim 1, for the means to adhere includes at least one of a double-sided tape, glue or mounting brackets.

3. A method of providing exposure to a shower stall comprising the steps of:

installing a first channel frame onto a first sidewall of a shower stall, wherein the first channel frame extends the entire length of the first sidewall;

installing a second channel frame onto a second sidewall of a shower stall, wherein the second channel frame extends the entire length of the second sidewall, where the second sidewall opposes the first sidewall;

inserting a shower rod into the first channel frame and the second channel frame; and moving the shower rod laterally within the first channel frame and second channel frame to expose the shower stall.

* * * * *